US007781939B2

(12) United States Patent
Fripp et al.

(10) Patent No.: US 7,781,939 B2
(45) Date of Patent: Aug. 24, 2010

(54) THERMAL EXPANSION MATCHING FOR ACOUSTIC TELEMETRY SYSTEM

(75) Inventors: Michael L. Fripp, Carrollton, TX (US); John P. Rodgers, Trophy Club, TX (US); Adam D. Wright, McKinney, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 12/472,470

(22) Filed: May 27, 2009

(65) Prior Publication Data

US 2009/0245024 A1 Oct. 1, 2009

Related U.S. Application Data

(62) Division of application No. 11/459,398, filed on Jul. 24, 2006, now Pat. No. 7,557,492.

(51) Int. Cl.
*H01L 41/04* (2006.01)
*H01L 41/053* (2006.01)

(52) U.S. Cl. ..... 310/334; 310/26; 310/322; 310/346

(58) Field of Classification Search ..... 310/322, 310/334, 335, 337, 346, 26
See application file for complete search history.

(56) References Cited

U.S. PATENT DOCUMENTS

| | | | |
|---|---|---|---|
| 3,905,010 | A | 9/1975 | Fitzpatrick |
| 4,283,780 | A | 8/1981 | Nardi |
| 4,293,936 | A | 10/1981 | Cox et al. |
| 4,302,826 | A | 11/1981 | Kent et al. |
| 4,314,365 | A | 2/1982 | Petersen et al. |
| 4,525,715 | A | 6/1985 | Smith |
| 4,562,559 | A | 12/1985 | Sharp et al. |
| 4,788,544 | A | 11/1988 | Howard |
| 4,839,644 | A | 6/1989 | Safinya et al. |
| 5,128,901 | A | 7/1992 | Drumheller |

(Continued)

FOREIGN PATENT DOCUMENTS

| | | | |
|---|---|---|---|
| EP | 636763 | A2 | 7/1994 |

(Continued)

OTHER PUBLICATIONS

Hanagud, S., De Noyer, M.B., Luo, H., Henderson, D., and Nagaraja, K.S., Tail buffet Alleviation of High Performance Twin Tail Aircraft Using Plezo-Stack Actuators, AIAA-99/1320, American Institute of Aeronautics and Astronautics, 1999, 11 pages.

(Continued)

*Primary Examiner*—Walter Benson
*Assistant Examiner*—Derek J Rosenau
(74) *Attorney, Agent, or Firm*—Marlin R. Smith

(57) ABSTRACT

Thermal expansion matching for an acoustic telemetry system. An acoustic telemetry system includes at least one electromagnetically active element and a biasing device which reduces a compressive force in the element in response to increased temperature. A method of utilizing an acoustic telemetry system in an elevated temperature environment includes the steps of: applying a compressive force to at least one electromagnetically active element of the telemetry system; and reducing the compressive force as the temperature of the environment increases.

11 Claims, 5 Drawing Sheets

U.S. PATENT DOCUMENTS

| | | | |
|---|---|---|---|
| 5,128,902 | A | 7/1992 | Spinnler |
| 5,130,706 | A | 7/1992 | Van Steenwyk |
| 5,148,408 | A | 9/1992 | Matthews |
| 5,160,925 | A | 11/1992 | Dailey et al. |
| 5,163,521 | A | 11/1992 | Pustanyk et al. |
| 5,222,049 | A | 6/1993 | Drumheller |
| 5,319,610 | A | 6/1994 | Airhart |
| 5,373,481 | A | 12/1994 | Orban et al. |
| 5,448,227 | A | 9/1995 | Orban et al. |
| 5,467,083 | A | 11/1995 | McDonald et al. |
| 5,477,505 | A | 12/1995 | Drumheller |
| 5,568,448 | A | 10/1996 | Tanigushi et al. |
| 5,576,703 | A | 11/1996 | MacLeod et al. |
| 5,592,438 | A | 1/1997 | Rorden et al. |
| 5,675,325 | A | 10/1997 | Taniguchi et al. |
| 5,703,836 | A | 12/1997 | Drumheller |
| 5,732,776 | A | 3/1998 | Tubel et al. |
| 5,831,549 | A | 11/1998 | Gearhart |
| 5,914,911 | A | 6/1999 | Babour et al. |
| 5,924,499 | A | 7/1999 | Birchak et al. |
| 5,941,307 | A | 8/1999 | Tubel |
| 5,942,990 | A | 8/1999 | Smith et al. |
| 6,018,301 | A | 1/2000 | Smith |
| 6,018,501 | A | 1/2000 | Smith |
| 6,028,534 | A | 2/2000 | Ciglenec et al. |
| 6,075,462 | A | 6/2000 | Smith |
| 6,108,268 | A | 8/2000 | Moss |
| 6,114,972 | A | 9/2000 | Smith |
| 6,137,747 | A | 10/2000 | Shah |
| 6,144,316 | A | 11/2000 | Skinner |
| 6,160,492 | A | 12/2000 | Herman |
| 6,177,882 | B1 | 1/2001 | Ringgenberg et al. |
| 6,188,222 | B1 | 2/2001 | Seydoux et al. |
| 6,188,647 | B1 | 2/2001 | Drumheller |
| 6,192,988 | B1 | 2/2001 | Tubel |
| 6,234,257 | B1 | 5/2001 | Ciglenec et al. |
| 6,272,916 | B1 | 8/2001 | Taniguchi et al. |
| 6,308,562 | B1 | 10/2001 | Abdallah et al. |
| 6,320,820 | B1 | 11/2001 | Gardner et al. |
| 6,370,082 | B1 | 4/2002 | Gardner et al. |
| 6,392,561 | B1 | 5/2002 | Davies et al. |
| 6,434,084 | B1 | 8/2002 | Schultz |
| 6,442,105 | B1 | 8/2002 | Tubel et al. |
| 6,443,228 | B1 | 9/2002 | Aronstam et al. |
| 6,450,258 | B2 | 9/2002 | Green et al. |
| 6,462,672 | B1 | 10/2002 | Besson |
| 6,464,011 | B2 | 10/2002 | Tubel |
| 6,464,021 | B1 | 10/2002 | Edwards |
| 6,469,635 | B1 | 10/2002 | Hudson |
| 6,470,996 | B1 | 10/2002 | Kyle et al. |
| 6,552,665 | B1 | 4/2003 | Miyamae et al. |
| 6,577,244 | B1 | 6/2003 | Clark et al. |
| 6,583,729 | B1 | 6/2003 | Gardner et al. |
| 6,614,360 | B1 | 9/2003 | Leggett, III et al. |
| 6,626,248 | B1 | 9/2003 | Roberts et al. |
| 6,633,236 | B2 | 10/2003 | Vinegar et al. |
| 6,657,597 | B2 | 12/2003 | Rodney et al. |
| 6,691,779 | B1 | 2/2004 | Sezginer et al. |
| 6,697,298 | B1 | 2/2004 | Dubinsky et al. |
| 6,745,833 | B2 | 6/2004 | Aronstam et al. |
| 6,757,218 | B2 | 6/2004 | Dubinsky |
| 6,768,700 | B2 | 7/2004 | Veneruso et al. |
| 6,781,520 | B1 | 8/2004 | Smith et al. |
| 6,781,521 | B1 | 8/2004 | Gardner et al. |
| 6,784,599 | B1 | 8/2004 | Stoecklein et al. |
| 6,801,136 | B1 | 10/2004 | Goodman et al. |
| 6,819,260 | B2 | 11/2004 | Gardner et al. |
| 6,843,120 | B2 | 1/2005 | Standen |
| 6,847,585 | B2 | 1/2005 | MacPherson |
| 6,899,178 | B2 | 5/2005 | Tubel |
| 6,912,177 | B2 | 6/2005 | Smith |
| 7,080,699 | B2 | 7/2006 | Lovell et al. |
| 7,084,782 | B2 | 8/2006 | Davies et al. |
| 7,257,050 | B2 | 8/2007 | Stewart et al. |
| 2002/0043369 | A1 | 4/2002 | Vinegar |
| 2002/0167418 | A1 | 11/2002 | Goswami |
| 2003/0010495 | A1 | 1/2003 | Mendez |
| 2003/0026167 | A1 | 2/2003 | Hahn |
| 2003/0151977 | A1 | 8/2003 | Shah |
| 2003/0192692 | A1 | 10/2003 | Tubel |
| 2004/0004553 | A1 | 1/2004 | Rodney |
| 2004/0020643 | A1 | 2/2004 | Thomeer |
| 2004/0035608 | A1 | 2/2004 | Meehan |
| 2004/0047235 | A1 | 3/2004 | Kyle |
| 2004/0105342 | A1 | 6/2004 | Gardner |
| 2004/0200613 | A1 | 10/2004 | Fripp |
| 2004/0202047 | A1 | 10/2004 | Fripp |
| 2004/0204856 | A1 | 10/2004 | Jenkins |
| 2004/0246141 | A1 | 12/2004 | Tubel |
| 2004/0263350 | A1 | 12/2004 | Vinegar |
| 2005/0000279 | A1 | 1/2005 | Yogeswaren |
| 2005/0024232 | A1 | 2/2005 | Gardner |
| 2005/0046588 | A1 | 3/2005 | Wisler |
| 2005/0056419 | A1 | 3/2005 | Hosie |
| 2005/0168349 | A1 | 8/2005 | Huang et al. |
| 2005/0194182 | A1 | 9/2005 | Rodney |
| 2006/0090893 | A1 | 5/2006 | Sheffield |
| 2006/0220650 | A1 | 10/2006 | Lovell et al. |
| 2006/0233048 | A1 | 10/2006 | Froelich et al. |
| 2006/0279177 | A1* | 12/2006 | D'Almeida et al. ..... 310/348 |
| 2008/0137481 | A1 | 6/2008 | Shah et al. |

FOREIGN PATENT DOCUMENTS

| | | | |
|---|---|---|---|
| EP | 0773345 | A1 | 5/1997 |
| EP | 08822871 | A2 | 12/1998 |
| EP | 932054 | A2 | 7/1999 |
| EP | 1467060 | A1 | 10/2004 |
| EP | 1662673 | A1 | 5/2006 |
| GB | 2247477 | A | 3/1992 |
| GB | 2249419 | A | 5/1992 |
| GB | 2340520 | A | 2/2000 |
| GB | 2370144 | A | 6/2002 |
| GB | 2410512 | A | 8/2005 |
| GB | 2416463 | A | 1/2006 |
| RU | 2190097 | C2 | 9/2002 |
| RU | 2194161 | C2 | 12/2002 |
| RU | 2215142 | C1 | 10/2003 |
| RU | 2229733 | C2 | 5/2004 |
| WO | 9962204 | A1 | 12/1999 |
| WO | 0212676 | A1 | 2/2002 |
| WO | 03067029 | A1 | 8/2003 |
| WO | 2006019935 | A2 | 2/2006 |

OTHER PUBLICATIONS

Halliburton Sunrise™ Telemetry System product brochure, 2004, 2 pages.

EPO Search Report issued Sep. 28, 2007, for European Patent Application Serial No. 07252925.8, 7 pages.

EPO Search Report issued Nov. 13, 2007, for European Patent Application Serial No. 07252917.5, 6 pages.

Office Action issued Oct. 3, 2008, for U.S. Appl. No. 11/459,402, 27 pages.

Office Action issued Feb. 9, 2009, for U.S. Appl. No. 11/459,397, 29 pages.

Office Action issued May 29, 2009 for U.S. Appl. No. 11/459,402, 32 pages.

Morgan Electro Ceramics, Effects of High Static Stress on the Piezoelectric Properties of Transducer Materials, Technical Publication TP-220, undated, 6 pages.

EPO Searh Report issued Oct. 23, 2007 for European Patent Application Serial No. 07252916.7, 5 pages.

* cited by examiner

THERMAL EXPANSION MATCHING FOR ACOUSTIC TELEMETRY SYSTEM

CROSS-REFERENCE TO RELATED APPLICATION

This application is a division of prior application Ser. No. 11/459,398 filed on Jul. 24, 2006. The entire disclosure of this prior application is incorporated herein by this reference.

BACKGROUND

The present invention relates generally to equipment utilized and operations performed in conjunction with wireless telemetry and, in an embodiment described herein, more particularly provides thermal expansion matching for an acoustic telemetry system used with a subterranean well.

In order to stabilize a stack of electromagnetically active elements (such as piezoceramic, electrostrictive or magnetostrictive discs or rings) during transport and handling, thereby preventing damage to the elements, a compressive force is typically applied to the elements. The compressive force also operates to bias the elements against a transmission medium (such as a tubular string in a well), thereby ensuring adequate acoustic coupling between the transmission medium and the elements.

To prevent the compressive force from being reduced or even eliminated as temperature increases (due to the fact that the elements generally have a coefficient of thermal expansion which is much less than a housing in which the elements are contained), various methods have been proposed which attempt to equalize the compressive force over a range of temperature variation. In these methods, the compressive force remains substantially constant (or even increases somewhat) as the temperature increases.

However, there are several problems with these prior methods. For example, these methods are not able to take advantage of the fact that most electromagnetically active elements are less susceptible to compressive depolarization at reduced temperatures. Thus, more compressive force may be satisfactorily applied to an electromagnetically active material as temperature decreases, providing enhanced protection from damage during handling. As another example, efforts directed at providing a substantially constant compressive force have resulted in increased assembly lengths, which in turn increases the cost and decreases the convenience of utilizing these methods.

SUMMARY

In carrying out the principles of the present invention, an acoustic telemetry system is provided which solves at least one problem in the art. One example is described below in which a compressive force applied to electromagnetically active elements is decreased as temperature increases. Other examples are described below in which a thermal compensation material is used alternately in series and in parallel with electromagnetically active elements.

In one aspect of the invention, an acoustic telemetry system is provided which includes at least one electromagnetically active element, and a biasing device which reduces a compressive force in the element in response to increased temperature. The biasing device may include impedance matching between the electromagnetically active element and a transmission medium. The biasing device may include mating surfaces which are shaped to reduce or eliminate forces applied to the electromagnetically active element transverse to the compressive force.

In another aspect of the invention, a method of utilizing an acoustic telemetry system is provided. The method includes the steps of: applying a compressive force to at least one electromagnetically active element of the telemetry system; and reducing the compressive force as the temperature of the environment increases. The method may include installing the element in a wellbore, and reducing the compressive force as the temperature of the wellbore increases.

These and other features, advantages, benefits and objects of the present invention will become apparent to one of ordinary skill in the art upon careful consideration of the detailed description of representative embodiments of the invention hereinbelow and the accompanying drawings, in which similar elements are indicated in the various figures using the same reference numbers.

DETAILED DESCRIPTION

It is to be understood that the various embodiments of the present invention described herein may be utilized in various orientations, such as inclined, inverted, horizontal, vertical, etc., and in various configurations, without departing from the principles of the present invention. The embodiments are described merely as examples of useful applications of the principles of the invention, which is not limited to any specific details of these embodiments.

In the following description of the representative embodiments of the invention, directional terms, such as "above", "below", "upper", "lower", etc., are used for convenience in referring to the accompanying drawings. In general, "above", "upper", "upward" and similar terms refer to a direction toward the earth's surface along a wellbore, and "below", "lower", "downward" and similar terms refer to a direction away from the earth's surface along the wellbore.

Figure 1:
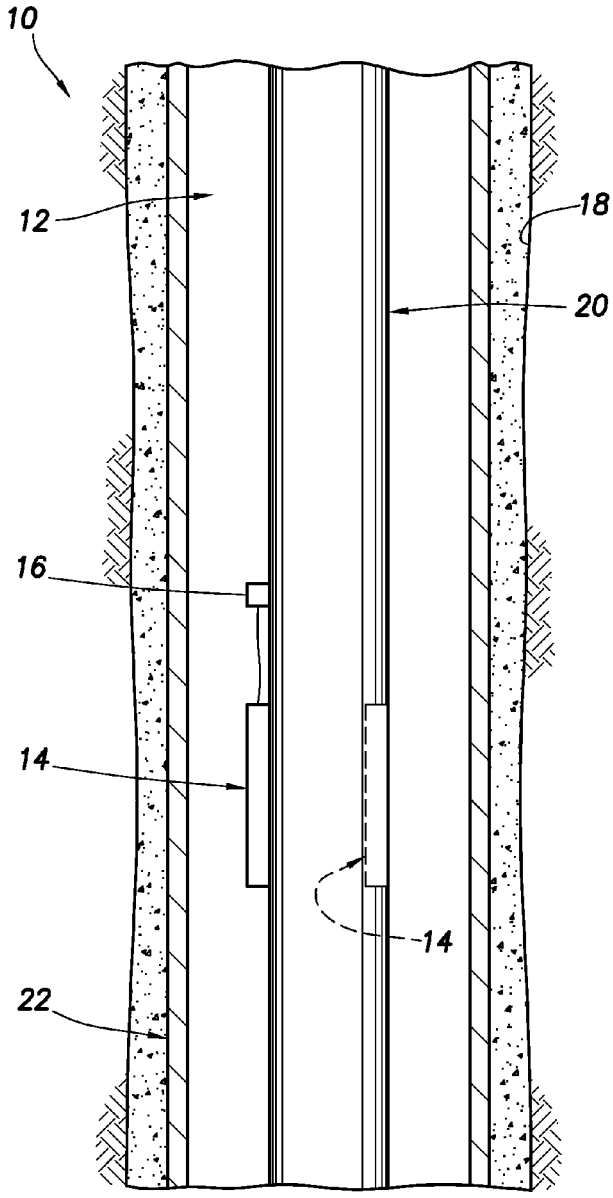
FIG. 1 is a schematic partially cross-sectional view of a well system embodying principles of the present invention.

Representatively illustrated in FIG. 1 is a well system 10 which embodies principles of the present invention. An acoustic telemetry system 12 is used to communicate signals (such as data and/or control signals) between a downhole portion 14 of the telemetry system and a remote or surface portion of the telemetry system (not visible in FIG. 1). For example, the downhole portion 14 may be connected to a sensor, well tool actuator or other device 16, and the transmitted signals may be used to collect data from the sensor, control actuation of the well tool, etc.

The configuration of the telemetry system 12 depicted in FIG. 1 should be clearly understood as merely a single example of a wide variety of uses for the principles of the invention. For example, although the telemetry system 12 is illustrated as being at least partially positioned in a wellbore 18 of a subterranean well, the invention could readily be used at the surface or at other locations. As another example, although the telemetry system 12 utilizes a tubular string positioned within a casing or liner string 22 as a transmission medium 20 for conveying acoustic signals, the casing or liner string (or another transmission medium) could be used instead.

As further examples, the downhole portion 14 and/or device 16 of the telemetry system 12 is not necessarily external to the tubular string 20 (e.g., the downhole portion could be internal to the tubular string as indicated by the downhole portion depicted in dashed lines in FIG. 1), the downhole portion and device could be incorporated into a single assembly, the downhole portion could include an acoustic transmitter, an acoustic receiver, an acoustic transceiver and/or other types of transmitters/receivers, communication between the device and the downhole portion may be via hardwired or any type of wireless communication, the downhole portion may be a repeater or may communicate with a repeater, etc. Therefore, it may be fully appreciated that the well system 10 depicted in FIG. 1 is merely representative of a vast number of systems which may incorporate the principles of the present invention.

An example of an acoustic transmitter which may be advantageously used as part of the downhole portion 14 of the telemetry system 12 is described in U.S. application Ser. No. 11/459,397, filed Jul. 24, 2006, and the entire disclosure of which is incorporated herein by this reference.

Figure 2:
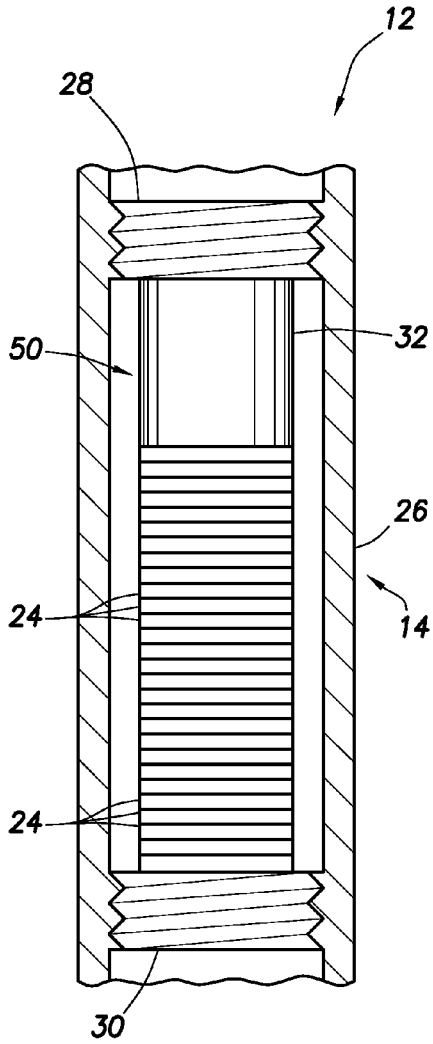
FIG. 2 is an enlarged scale schematic partially cross-sectional view of a downhole portion of an acoustic telemetry system used in the well system of FIG. 1.

Referring additionally now to FIG. 2, a first configuration of the downhole portion 14 of the telemetry system 12 is representatively illustrated in an enlarged scale partially cross-sectional view. In this view it may be seen that the downhole portion 14 includes a stack of multiple electromagnetically active elements 24 arranged within a housing 26. Preferably, the housing 26 is attached to the tubular string 20 in the manner described in the copending application referred to above, but other configurations and methods of acoustically coupling the elements 24 to a transmission medium may be used in keeping with the principles of the invention.

Electromagnetically active elements are made of materials which deform in response to application of an electrical potential or magnetic field thereto, or which produce an electrical potential or magnetic field in response to deformation of the material. Examples of materials which are electromagnetically active include piezoceramics, electrostrictive and magnetostrictive materials.

Threaded nuts 28, 30 are used to apply a compressive force to the elements 24 as depicted in FIG. 2. However, it should be clearly understood that any manner of applying a compressive force to the elements 24 may be used without departing from the principles of the invention. For example, only a single one of the nuts 28, 30 may be used, one or more mechanical or fluid springs may be used, other types of biasing devices may be used, etc.

It will be readily appreciated by those skilled in the art that, as the temperature of the downhole portion 14 of the telemetry system 12 increases (such as, when the downhole portion is installed in the wellbore 18, when production is commenced, etc.), the elements 24 and the housing 26 will expand according to the coefficient of thermal expansion of the material from which each of these is made. In the case of the elements 24 being made of a ceramic material and the housing 26 being made of a steel material (which is the typical case), the housing will expand far more than the elements, since steel has a coefficient of thermal expansion which is much greater than that of ceramic.

In order to compensate for this difference in thermal expansion, a thermal compensation material 32 is positioned in series with the elements 24. As depicted in FIG. 2, the compressive force applied to the elements 24 is also applied to the thermal compensation material 32. In this manner, greater thermal expansion of the material 32 will result in an increase in the compressive force, and lesser thermal expansion of the material will result in a decrease in the compressive force.

In one beneficial feature, the material 32 has a selected coefficient of thermal expansion and is appropriately dimensioned, so that the compressive force in the elements 24 decreases as the temperature of the ambient environment increases. Preferably, the material 32 has a coefficient of thermal expansion which is greater than that of the elements 24. Since the length of the material 32 is preferably less than the length of the housing 26 between the nuts 28, 30, the coefficient of thermal expansion of the material 32 is also preferably greater than that of the housing.

If the housing 26 is made of steel and the elements 24 are made of ceramic, then appropriate selections for the material 32 may include alloys of zinc, aluminum, lead, copper or steel. For example, an acceptable copper alloy may be a bronze material.

By decreasing the compressive force in the elements 24 as the temperature increases, compressive depolarization of the elements at the increased temperature can be more positively avoided. In addition, increased compressive force can be applied to the elements 24 while the temperature is relatively low (such as at the surface prior to installation, or upon retrieval of the downhole portion 14 after installation), thereby providing increased stabilization of the elements during transport and handling.

In this example of a series configuration of the material 32 and elements 24 illustrated in FIG. 2, the relationship between thermal expansion of the various components can be represented in equation form as:

$$TE(\text{material } 32)+TE(\text{elements } 24)<TE(\text{housing } 26) \quad (1)$$

where TE is the linear thermal expansion of the respective components in the direction of application of the compressive force. Of course, when the temperature decreases, thermal expansion is replaced by thermal contraction.

Note that the invention is not limited to the configuration of FIG. 2 or the equation (1) presented above. Other configurations could be devised in which, for example, the material 32 has a length greater than that of the housing 26 between the nuts 28, 30 (in which case the coefficient of thermal expansion of the material may be less than that of the housing), components other than the material 32 and housing 26 have thermal expansion which affects the compressive force in the elements 24, etc.

Furthermore, although the material 32 is depicted in FIG. 2 as being in series with the elements 24, other configurations could be devices in which the material is in parallel with the elements. In this alternate configuration, the coefficient of thermal expansion of the material 32 could be selected so that the compressive force in the elements 24 decreases somewhat as temperature increases.

Figure 3:
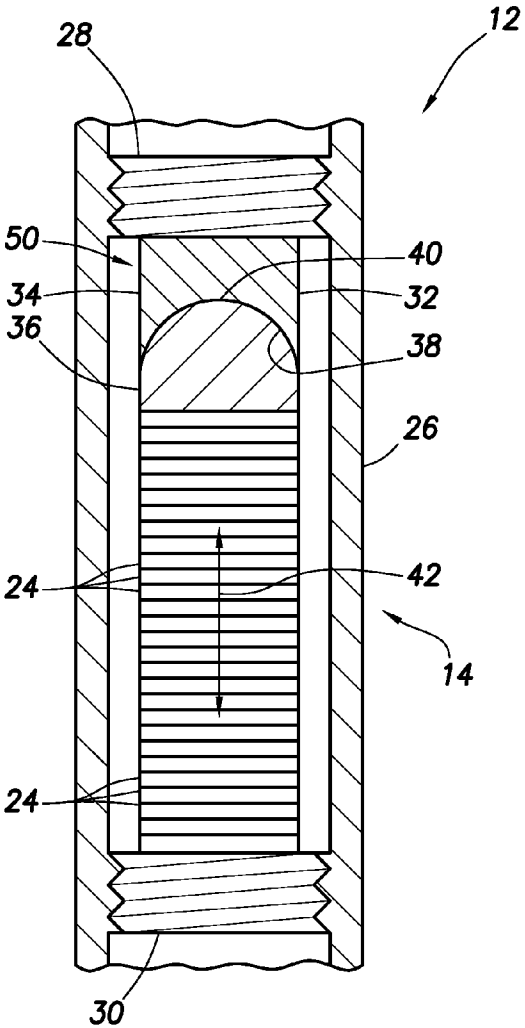

Although the material 32 is depicted in FIG. 2 as being in a cylindrical form, many other configurations are possible. In FIG. 3, an alternate configuration is representatively illustrated in which the material 32 is provided in multiple sections 34, 36.

The sections 34, 36 have complementarily curved or spherically shaped mating support surfaces 38, 40 which operate to centralize or otherwise stabilize the material 32 and elements 24, and operate to prevent or at least reduce the application of tensile forces to the elements due to bending when the downhole portion 14 is subjected to accelerations transverse to the direction 42 of the compressive force. Such transverse accelerations and resulting tensile forces could result from mishandling, shock loads during transport, etc., and may readily damage the elements 24.

The surfaces 38, 40 may also compensate for surface imperfections and machining misalignments during assembly to reduce localized stresses. The surfaces 38, 40 may also permit relative rotation therebetween, for example, to prevent transmission of torque or bending moments from the nut 28 to the elements 24.

The surfaces 38, 40 are not necessarily curved or spherical in shape. Examples of shapes which may be used include conical, frusto-conical, polygonal, polyhedral, etc. In addition, the surfaces 38, 40 are not necessarily formed between sections 34, 36 of the material 32, for example, the surfaces could be formed between the material and the nut 28, etc.

Figure 4:
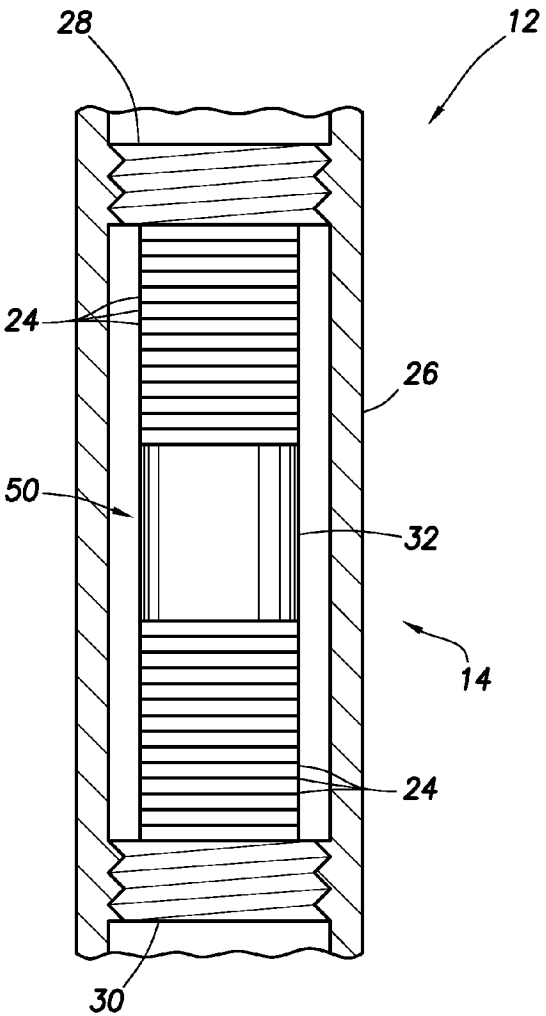
FIGS. 3-8 are schematic partially cross-sectional views of alternate constructions of the downhole portion of the telemetry system.

Referring additionally now to FIG. 4, another alternate configuration is representatively illustrated in which the material 32 is positioned between multiple sets of the elements 24. Thus, it will be appreciated that any relative positions of the material 32 and elements 24 may be used in keeping with the principles of the invention.

Figure 5:
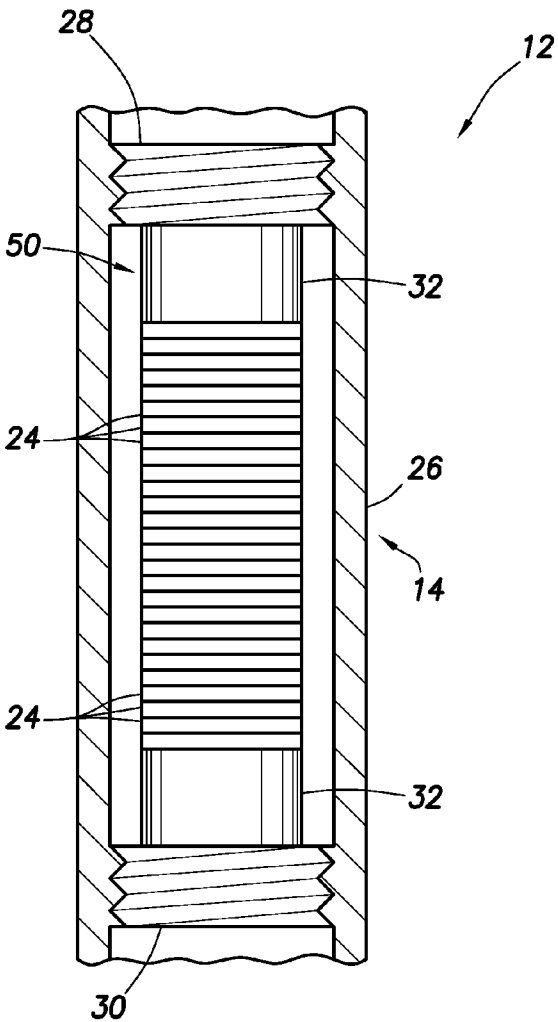

Referring additionally now to FIG. 5, another alternate configuration is representatively illustrated in which multiple ones of the material 32 are used, with each being positioned at an end of the stack of elements 24. Thus, it will be appreciated that any number of the material 32 may be used, and any positioning of the material relative to the elements 24 may be used in keeping with the principles of the invention.

Figure 6:
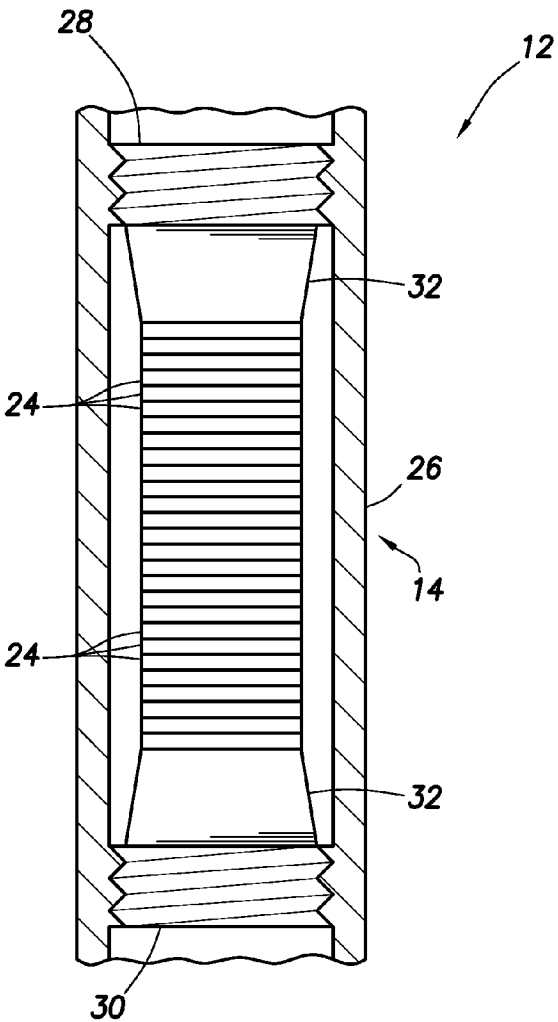

Referring additionally now to FIG. 6, another alternate configuration is representatively illustrated in which the material 32 is used to provide acoustic impedance matching between the elements 24 and the housing 26/nuts 28, 30 assembly (and via the housing to the transmission medium 20).

Acoustic impedance, z, can be derived from the d'Alembert solution of the wave equation, in which $$z=A\sqrt{\rho E} \tag{2}$$

and wherein A is the cross-sectional area, ρ is the material density, and E is the material modulus.

The material 32 can provide for acoustic impedance matching in various different ways, and combinations thereof. For example, the material 32 can have a selected density and modulus, so that its acoustic impedance is between that of the elements 24 and that of the housing 26/nuts 28, 30 assembly. The density and/or modulus of the material 32 can vary along its length (e.g. by using varied density sintered material or functionally graded material), so that at one end thereof its acoustic impedance matches that of the elements 24, and at the other end its acoustic impedance matches that of the housing 26/nuts 28, 30 assembly.

As another example, the material 32 can have a selected shape, so that its cross-sectional area varies in a manner such that at one end thereof its acoustic impedance matches that of the elements 24, and at the other end its acoustic impedance matches that of the housing 26/nuts 28, 30 assembly. A frusto-conical shape of the material 32 is depicted in FIG. 6, but other shapes may be used in keeping with the principles of the invention.

The preferable end result is that internal acoustic reflections in the acoustic coupling between the elements 24 and the transmission medium 20 are minimized. By utilizing the material 32 to accomplish acoustic impedance matching, the performance of the telemetry system 12 is enhanced, and the cost and complexity of the system is reduced as compared to accomplishing this objective with multiple separate components.

Figure 7:
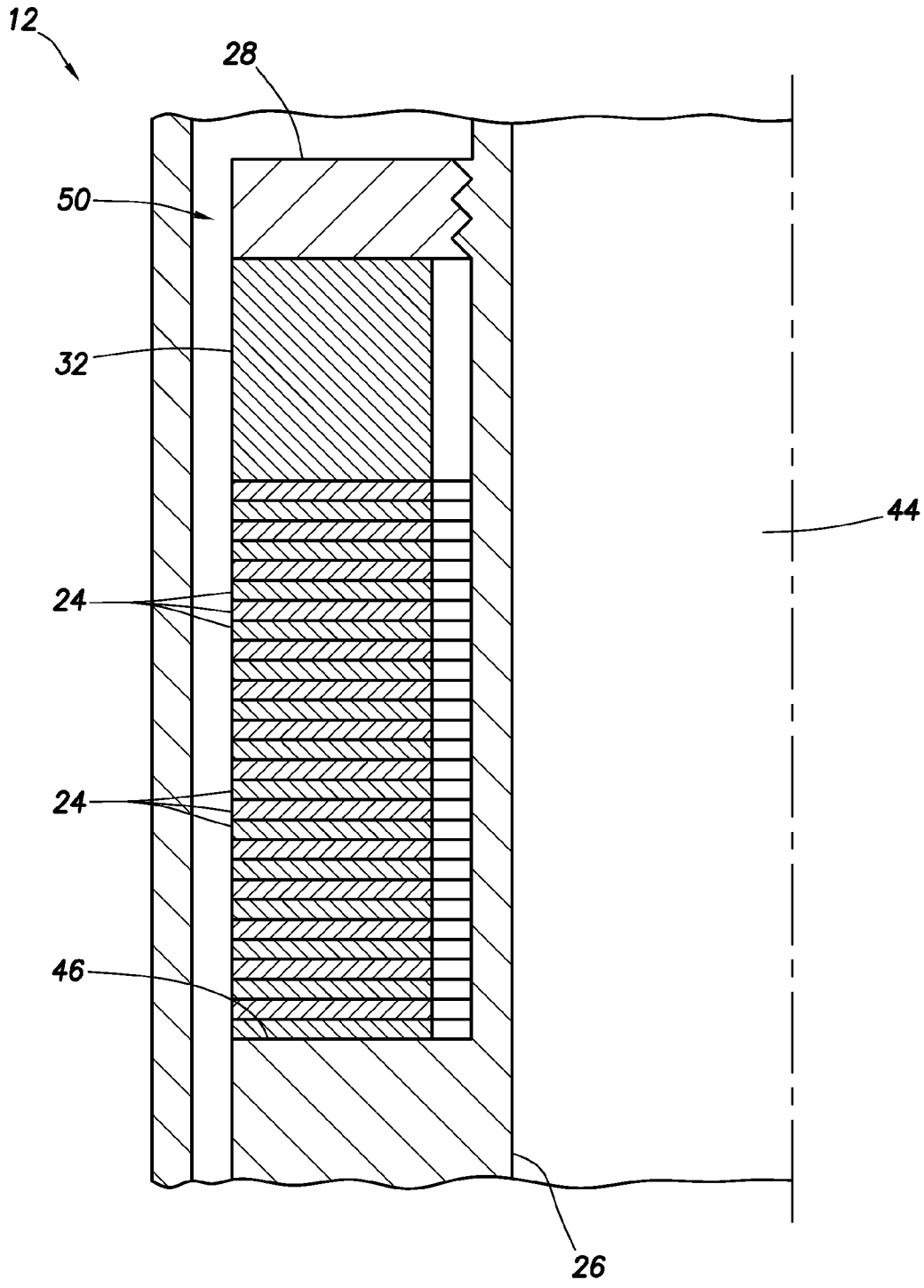

Representatively illustrated in FIG. 7 is another alternate configuration in which the elements 24 are annular-shaped, instead of disc-shaped as in the previously described examples. The material 32 and the nut 28 are also annular-shaped accordingly. Thus, it will be appreciated that any shape may be used for any of the components of the telemetry system 12 in keeping with the principles of the invention.

In addition, the housing 26 as depicted in FIG. 7 encircles an inner flow passage 44 which may, for example, form a portion of an overall internal flow passage of the tubular string transmission medium 20 shown in FIG. 1. Thus, the housing 26 in this configuration may be considered a part of the tubular string.

Also, the lower nut 30 is not used in the configuration of FIG. 7. Instead, a shoulder 46 formed on the housing 26 is used to support and apply the compressive force to a lower end of the stack of elements 24. If, in yet another alternate configuration, the material 32 is used for acoustic impedance matching at the lower end of the stack of elements 24, then the material 32 could at one end thereof match the acoustic impedance of the lower annular element 24, and at the other end thereof match the acoustic impedance of the shoulder 46.

Thus, FIG. 7 further demonstrates the wide variety of configurations which are possible while still incorporating the principles of the invention.

Figure 8:
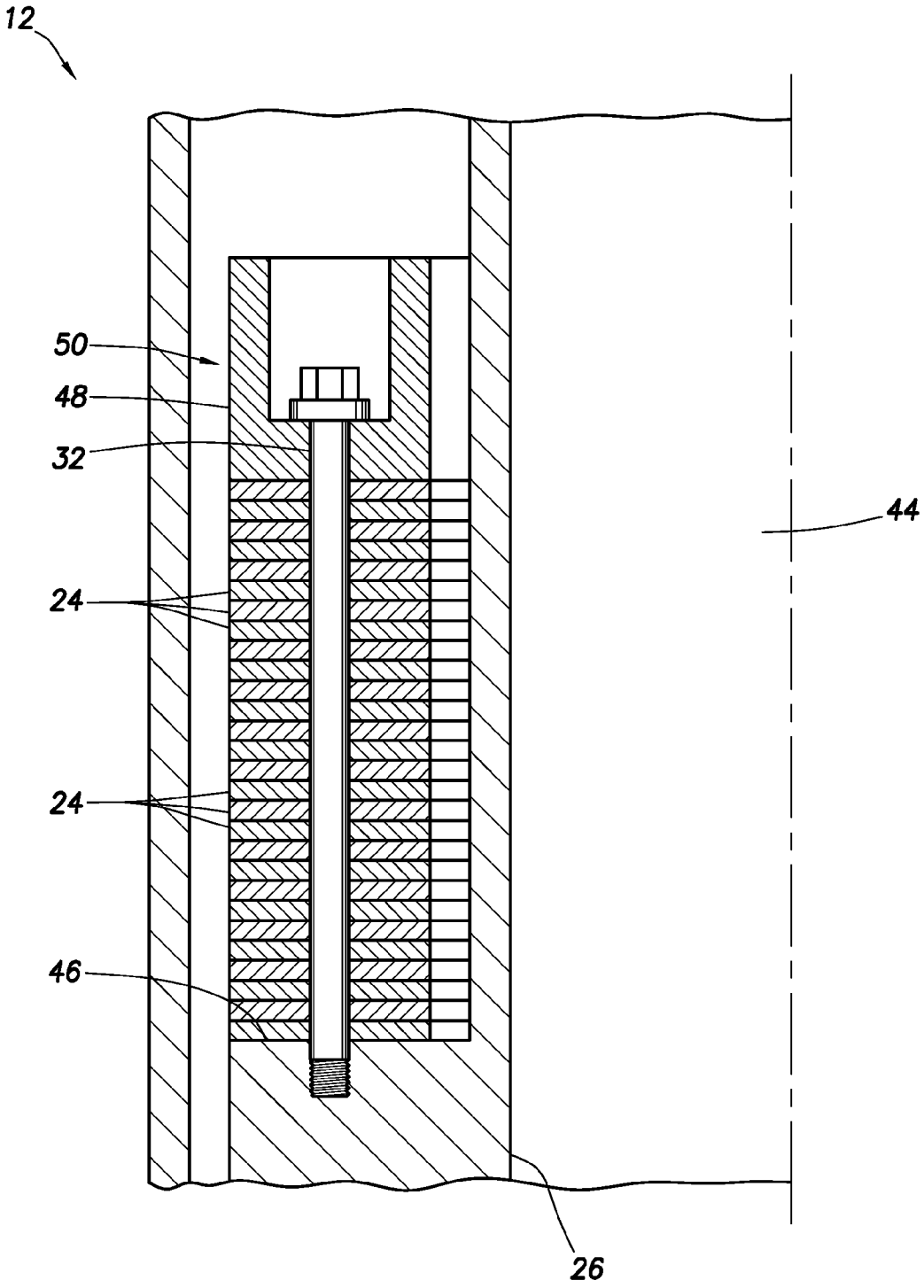

In FIG. 8 another alternate configuration is representatively illustrated which demonstrates yet another way in which the principles of the invention may be utilized. In this configuration, the material 32 is in the form of a fastener or threaded bolt which is used to apply the compressive force to the elements 24. Instead of the material 32 experiencing the same compressive force as the elements 24 (as in the other examples described above), in this case the material 32 experiences a tensile force when the compressive force is applied to the elements. Multiple ones of the threaded fastener-type material 32 may be used (e.g., circumferentially distributed about the housing 26) to apply the compressive force to the elements 24.

The material 32 as depicted in FIG. 8 may be considered to be in parallel with the elements 24, since the respective tensile and compressive forces therein are parallel and mutually dependent. Thus, as the tensile force in the material 32 decreases, the compressive force in the elements 24 also decreases.

However, the properties and dimensions of the material 32 may still be appropriately selected so that the compressive force in the elements 24 decreases as the temperature increases. For example, the material 32 could have a coefficient of thermal expansion which is somewhat greater than that of the elements 24. The coefficients of thermal expansion and dimensions of other components, such as that of an annular reaction mass 48 positioned at an end of the stack of elements 24, may also be selected to regulate the manner in which the compressive force in the elements varies with temperature.

In each of the above-described examples of the telemetry system 12, a biasing device 50 is formed by the material 32, housing 26, nuts 28, 30 and/or reaction mass 48. The overall beneficial result of the biasing device 50 in each of the above-described configurations, is that a compressive force is applied to the elements 24, which compressive force decreases with increased temperature, and which increases with decreased temperature. Although several different examples of configurations of the biasing device 50 have been described above, it should be clearly understood that other configurations with more, fewer and different components may be used without departing from the principles of the invention.

Preferably, the biasing device 50 is operative to decrease the compressive force in the elements 24 by approximately 50% in response to a temperature increase of 100° C. (or the compressive force increases by approximately 100% in response to a temperature decrease of 100° C.) in each of the above-described examples of the telemetry system 12. Most preferably, the compressive force in the elements 24 decreases by approximately 75% in response to a temperature increase of 100° C. (or the compressive force increases by approximately 300% in response to a temperature decrease of 100° C.). However, it should be clearly understood that other variations in compressive force with temperature may be used in keeping with the principles of the invention.

Of course, a person skilled in the art would, upon a careful consideration of the above description of representative embodiments of the invention, readily appreciate that many modifications, additions, substitutions, deletions, and other changes may be made to these specific embodiments, and such changes are within the scope of the principles of the present invention. Accordingly, the foregoing detailed description is to be clearly understood as being given by way of illustration and example only, the spirit and scope of the present invention being limited solely by the appended claims and their equivalents.

What is claimed is:

1. An acoustic telemetry system, comprising:

at least one electromagnetically active element; and a biasing device which reduces a compressive force in the element in response to increased temperature.

2. The telemetry system of claim 1, wherein the biasing device includes a thermal compensation material, the material having a coefficient of thermal expansion which is greater than that of the element.

3. The telemetry system of claim 2, wherein the material is subjected to the same compressive force as the element.

4. The telemetry system of claim 2, wherein the material is configured in series with the element.

5. The telemetry system of claim 2, wherein the compressive force results from a tensile force in the material.

6. The telemetry system of claim 2, wherein the material is configured in parallel with the element.

7. The telemetry system of claim 1, wherein the element is positioned in a wellbore, and wherein the biasing device reduces the compressive force in response to increased temperature in the wellbore.

8. The telemetry system of claim 1, wherein the element is acoustically coupled via the material to a member of the acoustic telemetry system which conveys acoustic signals, and wherein the material provides acoustic impedance matching between each of the element and the member.

9. The telemetry system of claim 1, wherein the element is supported by a structure, and further comprising a support surface between the element and the structure, whereby the surface prevents damage to the element due to acceleration in a direction transverse to the compressive force.

10. The telemetry system of claim 9, wherein the surface is configured as a curved surface.

11. The telemetry system of claim 9, wherein the surface is formed on a thermal compensation material.

* * * * *